US008276553B2

(12) United States Patent
Yamanishi et al.

(10) Patent No.: US 8,276,553 B2
(45) Date of Patent: Oct. 2, 2012

(54) WATER PUMP ATTACHMENT STRUCTURE OF WATER-COOLED INTERNAL COMBUSTION ENGINE

(75) Inventors: Teruhide Yamanishi, Saitama (JP); Ryuji Tsuchiya, Saitama (JP); Kenji Oki, Saitama (JP); Yutaka Miyake, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 476 days.

(21) Appl. No.: 12/635,398

(22) Filed: Dec. 10, 2009

(65) Prior Publication Data

US 2010/0162974 A1 Jul. 1, 2010

(30) Foreign Application Priority Data

Dec. 26, 2008 (JP) ..... 2008-333801

(51) Int. Cl.
*F01P 5/10* (2006.01)

(52) U.S. Cl. ..... 123/41.47; 123/198 C

(58) Field of Classification Search ..... 123/41.44, 123/41.47, 198 C, 90.23
See application file for complete search history.

(56) References Cited

U.S. PATENT DOCUMENTS 4,662,323 A * 5/1987 Moriya ..... 123/90.23

FOREIGN PATENT DOCUMENTS

JP 3963532 B2 6/2007

* cited by examiner

*Primary Examiner* — Nathaniel Wiehe
*Assistant Examiner* — Maria Aponte
(74) *Attorney, Agent, or Firm* — Birch, Stewart, Kolasch & Birch, LLP

(57) ABSTRACT

A water pump attachment structure of a water-cooled internal combustion engine is provided to facilitate the maintenance of a valve train. A water pump attachment structure of a water-cooled internal combustion engine includes a semicircular cut-away surface of a water pump holder opposed to a semicircular surface of a cylinder head to form a water pump support circular hole. Screw members are passed through respective screw through-holes of the cylinder head and threadedly engaged with internal thread holes of the water pump holder. Thus, the water pump holder is fastened to the cylinder head. A water pump is fitted into and secured to the water pump support circular hole. A cylinder head cover is attached to the cylinder head by allowing their mating surfaces to conform with each other with the water pump holder liquid-tightly sandwiched therebetween.

20 Claims, 8 Drawing Sheets

WATER PUMP ATTACHMENT STRUCTURE OF WATER-COOLED INTERNAL COMBUSTION ENGINE

CROSS-REFERENCE TO RELATED APPLICATIONS

The present application claims priority under 35 USC 119 to Japanese Patent Application No. 2008-333801 filed on Dec. 26, 2008 the entire contents of which are hereby incorporated by reference.

BACKGROUND OF THE INVENTION

1. Field of the Invention

The present invention relates to a water pump attachment structure of a water-cooled internal combustion engine.

2. Description of Background Art

A water-cooled internal combustion engine is known wherein a valve train having a camshaft disposed on a cylinder head is provided so as to be covered by a cylinder head cover. This internal combustion engine is configured as described below. A water pump housing for a water pump is provided across the cylinder head and cylinder head cover. In addition, a pump drive shaft rotatably supported in the water pump housing is disposed coaxially with a camshaft and rotated in conjunction with the rotation of the camshaft. See, for example, Japanese Patent No. 3,963,532.

Japanese Patent No. 3,963,532 discloses a water pump housing that is provided across the cylinder head and the cylinder head cover is attached to and supported by both the cylinder head and the cylinder head cover by means of bolts.

When the maintenance of the valve train such as adjustment of a tappet clearance is carried out, to remove the cylinder head cover, the water pump housing for the water pump has to be first removed from the cylinder head and the cylinder head cover. More specifically, work has to be done from a plurality of lateral sides of the engine, which makes the maintenance work cumbersome.

SUMMARY AND OBJECTS OF THE INVENTION

It is an object of an embodiment of the present invention to provide a water pump attachment structure for a water-cooled internal combustion engine that can facilitate the maintenance of a valve train.

According to an embodiment of the present invention, a water pump attachment structure of a water-cooled internal combustion engine is provided wherein a valve train having a camshaft disposed on a cylinder head is provided so as to be covered by a cylinder head cover. A water pump having a pump drive shaft directly driven by the camshaft is disposed across a mating surface of the cylinder head. A mating surface of the cylinder head cover is provided wherein the cylinder head has a sidewall formed with a semicircular cut-away surface resulting from cutting away the mating surface with the cylinder head cover in a semicircle with screw boss portions having screw through-holes passing through the mating surface. The screw boss portions are formed on both sides of the semicircular cut-away surface. A water pump holder is formed with a semicircular cut-away surface symmetrically opposed to the semicircular cut-away surface of the cylinder head, and with internal thread holes in the mating surface with the cylinder head so as to correspond to the respective screw through-holes to form a water pump support circular hole by allowing a semicircular cut-away surface thereof to face the semicircular cut-away surface of the cylinder head. Screw members are passed through the respective screw through-holes of the cylinder head and are threadedly engaged with the respective internal thread holes of the water pump holder so that the water pump holder is fastened to the cylinder head. A water pump is fitted into and secured to the water pump support circular hole. The cylinder head cover includes a mating surface allowed to conform to the mating surface of the cylinder head and is attached to the cylinder head with the water pump holder liquid-tightly sandwiched therebetween.

According to an embodiment of the present invention, the water pump holder is positioned with respect to and fastened to the cylinder head by a knock pin engaged with an engaging hole formed at a given position on the mating surface of the cylinder head and of the water pump holder.

According to an embodiment of the present invention, the screw through-holes of the cylinder head are formed adjacently to both respective sides of the semicircular cut-away surface, and the semicircular cut-away surface of the cylinder head has an axial width greater than an internal diameter of the screw through-hole.

According to an embodiment of the present invention, the corresponding semicircular cut-away surfaces of the water pump support circular hole formed by fastening the water pump holder to the cylinder head are subjected to planarization by a co-process, and a cylindrical portion of a water pump housing rotatably supporting the pump drive shaft of the water pump is liquid-tightly fitted into the water pump support circular hole via an O-ring to support the water pump.

According to an embodiment of the present invention, a cylindrical portion of a water pump housing rotatably supporting the pump drive shaft of the water pump is formed with a flange portion, and the cylindrical portion of the water pump housing is fitted into the water pump support circular hole so that the flange portion is liquid-tightly abutted against an external opening end face of the water pump support circular hole via an O-ring to support the water pump.

According to an embodiment of the present invention, an external sidewall defining a cam chain chamber of the cylinder head is formed with a water pump attachment bolt boss portion adapted to secure the water pump and with a cylinder head fastening bolt boss portion adapted to fasten the cylinder head to a cylinder block.

According to an embodiment of the present invention, the water pump holder, formed with a semicircular cut-away surface symmetrically opposed to the semicircular cut-away surface of the cylinder head, and with internal thread holes in the mating surface with the cylinder head so as to correspond to the respective screw through-holes, forms a water pump support circular hole by allowing a semicircular cut-away surface thereof to face the semicircular cut-away surface of the cylinder head. Screw members are passed through the respective screw through-holes of the cylinder head and threadedly engaged with the respective internal thread holes of the water pump holder so that the water pump holder is fastened to the cylinder head. The water pump is fitted into and secured to the water pump support circular hole. The cylinder head cover has the mating surface allowed to conform to the mating surface of the cylinder head and is attached to the cylinder head with the water pump holder liquid-tightly sandwiched therebetween. Thus, while maintaining the state where the water pump is fitted into the water pump support circular hole and secured to the cylinder head, the cylinder head cover is removed and maintenance work for the valve train 10 such as the adjustment of a tappet clearance can be done with ease.

In addition, in the state where the cylinder head cover is put on and fastened to the cylinder head, also the water pump can be removed. Therefore, maintenance work for the water pump can be done with ease.

In addition, the water pump having the pump drive shaft directly driven by the camshaft is disposed across the mating surface of the cylinder head and of the cylinder head cover. Therefore, the mating surfaces are made flush with the camshaft to lower the lateral wall of the cylinder head, thereby reducing the weight of the cylinder head.

According to the water pump attachment structure of the water-cooled internal combustion engine, the water pump holder is positioned with respect to and fastened to the cylinder head by a knock pin engaged with an engaging hole formed at a given position on the mating surface of the cylinder head and of the water pump holder. Thus, the accuracy of the attachment position of the water pump holder to the cylinder head can be highly maintained.

According to the water pump attachment structure of the water-cooled internal combustion engine, the screw through-holes of the cylinder head are formed adjacent to both respective sides of the semicircular cut-away surface, and the semicircular cut-away surface of the cylinder head has an axial width greater than an internal diameter of the screw through-hole. Therefore, while the axial width of the semicircular cut-away surface is increased to make the support of the water pump satisfactory, the broad semicircular cut-away surface is used to enlarge the screw boss portion of the screw through-hole, thereby achieving an increase in boss strength.

According to the water pump attachment structure of the water-cooled internal combustion engine, the corresponding semicircular cut-away surfaces of the water pump support circular hole formed by fastening the water pump holder to the cylinder head are subjected to planarization by a co-process. Therefore, the water pump support circular hole can be formed as a perfect-circular hole surface with a high degree of accuracy. In addition, the cylindrical portion of a water pump housing rotatably supporting the pump drive shaft of the water pump is liquid-tightly fitted into the water pump support circular hole via an O-ring. With such a simple structure, a high sealing-performance can be ensured.

According to the water pump attachment structure of the water-cooled internal combustion engine, the cylindrical portion of a water pump housing rotatably supporting the pump drive shaft of the water pump is formed with the flange portion, and the cylindrical portion of the water pump housing is fitted into the water pump support circular hole so that the flange portion is liquid-tightly abutted against the external opening end face of the water pump support circular hole via the O-ring to support the water pump. With such a simple structure, the sealing performance can be highly maintained without a co-process.

According to the water pump attachment structure of the water-cooled internal combustion engine, the external sidewall defining the cam chain chamber of the cylinder head is formed with the water pump attachment bolt boss portion adapted to secure the water pump and with the cylinder head fastening bolt boss portion adapted to fasten the cylinder head to a cylinder block. Therefore, the external sidewall of the cam chain chamber is formed with the bulging water pump attachment bolt boss portion and with the bulging cylinder head fastening bolt boss portion to increase the rigidity of the cylinder head in the vicinity of the cam chain chamber. Thus, the strength of the cylinder head fastening portion can be increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment according to the present invention will hereinafter be described with reference to FIGS. 1 to 8.

A water-cooled internal combustion engine 1 of the present embodiment is an internal combustion engine that adopts a single-cylinder 4-stroke SOHC valve system and is mounted on small-sized vehicles.

Figure 1:
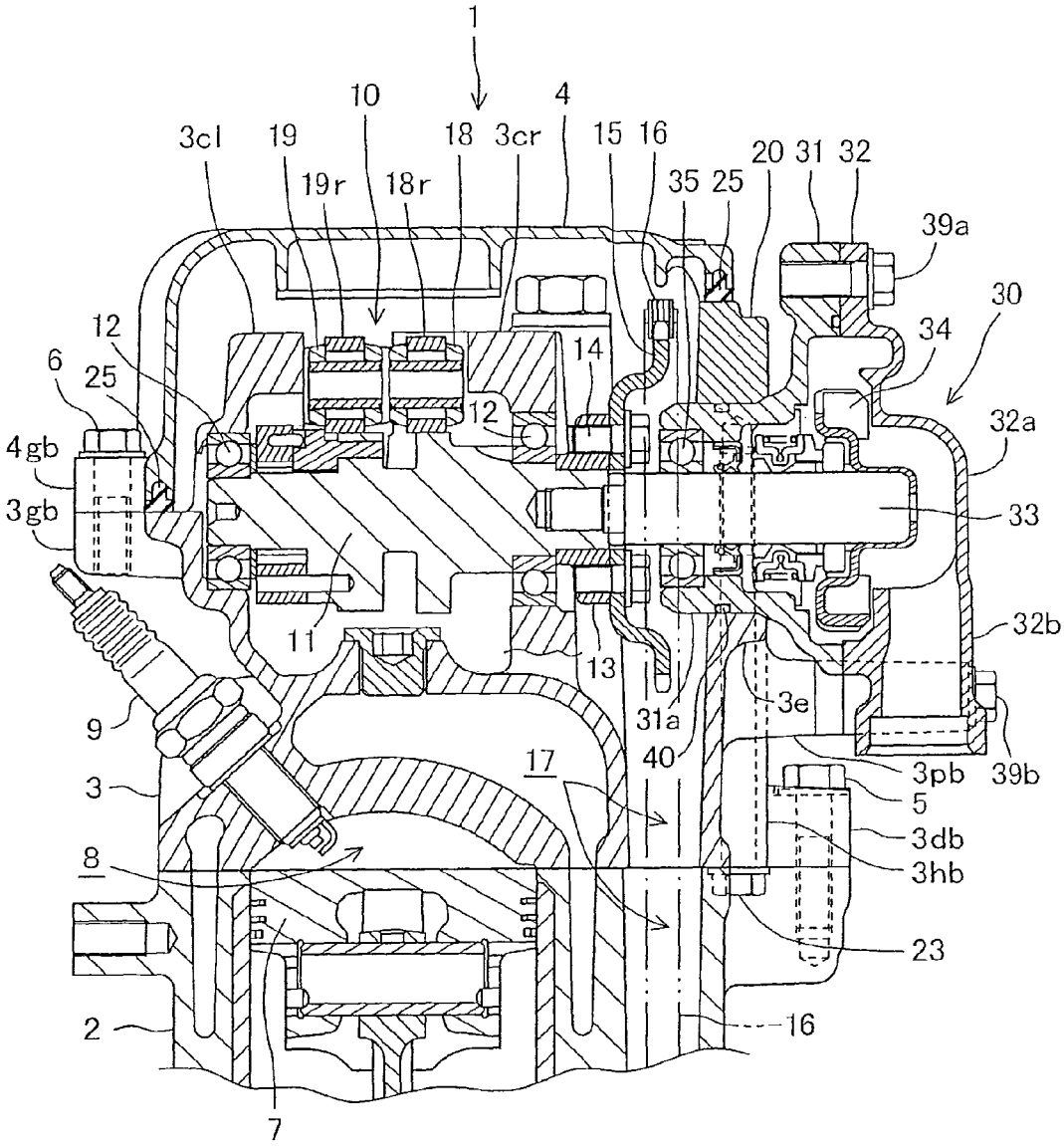
FIG. 1 is a cross-sectional view illustrating the vicinity of a cylinder head of an internal combustion engine according to an embodiment of the present invention.

FIG. 1 is a cross-sectional view illustrating the vicinity of a cylinder head 3 of the internal combustion engine 1.

The internal combustion engine 1 is mounted on a vehicle body so that a crankshaft is oriented in a width direction of the vehicle body and a cylinder is forwardly inclined. In the present embodiment, the vehicle body width direction is a left-right direction and the projecting direction of the cylinder is upside.

The cross-sectional view of FIG. 1 is such that left, right, up and down are indicated without modification.

The cylinder head 3 is put on a cylinder block 2 and both are fastened to each other by means of fastening bolts 5.

A valve train 10 provided on the upper portion of the cylinder head 3 is covered from above by a cylinder head cover 4, which is fastened to the cylinder head 3 by means of fastening bolts 6.

Figure 4:
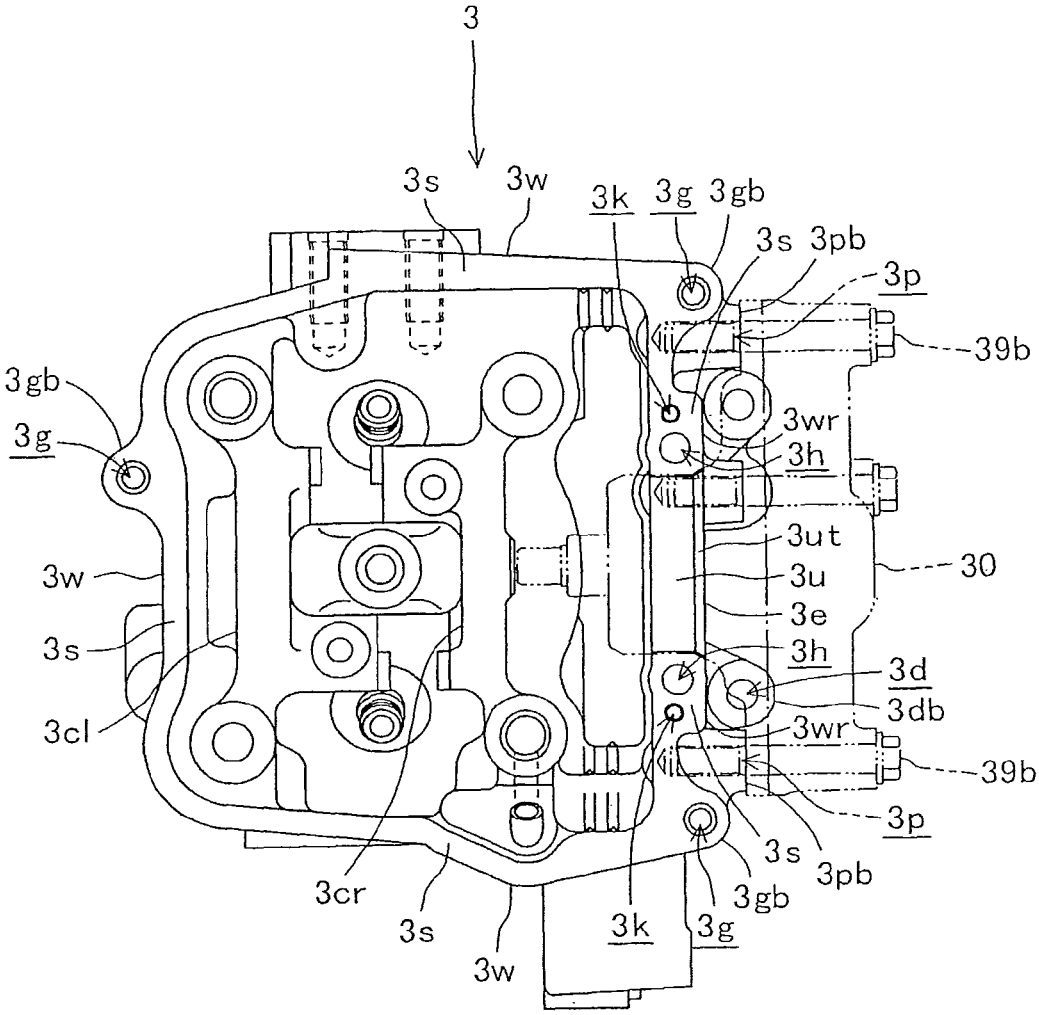
FIG. 4 is a plan view of the cylinder head.

Referring to FIG. 4, the cylinder head 3 is such that an end face of a rectangular outer lateral wall 3*w* is formed as a mating surface 3*s* with the cylinder head cover 4. In addition, a pair of left and right cam shaft-receiving walls 3*cl*, 3*cr* are formed on the inside surrounded by the outer lateral wall to project further upward from the mating surface 3*s*.

A camshaft 11 is rotatably mounted to the left and right camshaft-receiving walls 3*cl*, 3*cr* via respective bearings 12, 12 so as to extend in a left-right horizontal direction.

The central axis of the camshaft 11 lies on the same plane as the mating surface 3*s* of the cylinder head 3 with the cylinder head cover 4.

An annular attachment base 13 is fitted to a right end projecting from the right bearing 12 of the camshaft 11. A cam chain driven sprocket 15 is secured to the attachment base 13 by means of bolts 14 (see FIG. 1).

A cam chain 16 adapted to transmit power to the valve train 10 is spanned between the cam chain driven sprocket 15 fitted to the right end of the camshaft 11 and a cam chain drive sprocket (not illustrated) fitted to a crankshaft (not illustrated). Cam chain chambers 17 for such a cam chain and sprockets are provided in the cylinder block 2 and the cylinder head 3 to communicate with each other (see FIG. 1).

An intake cam surface and an exhaust cam surface of the cam shaft 11 are in contact with a roller 18*r* at an end of the intake rocker arm 18 and with a roller 19*r* at an end of the exhaust rocker arm 19, respectively.

In addition, in the cylinder head 3, an ignition plug 9 is obliquely inserted from the side (the left side) opposite the cam chain chamber 17 toward a combustion chamber 8 the top of a piston 7 faces (see FIG. 1).

In the internal combustion engine 1, a water pump 30 is attached between the respective mating surfaces 3*s*, 4*s* of the right sidewalls 3*wr*, 4*wr* in the respective external lateral walls 3*w*, 4*w* included in the cylinder head 3 and the cylinder head cover 4.

Figure 2:
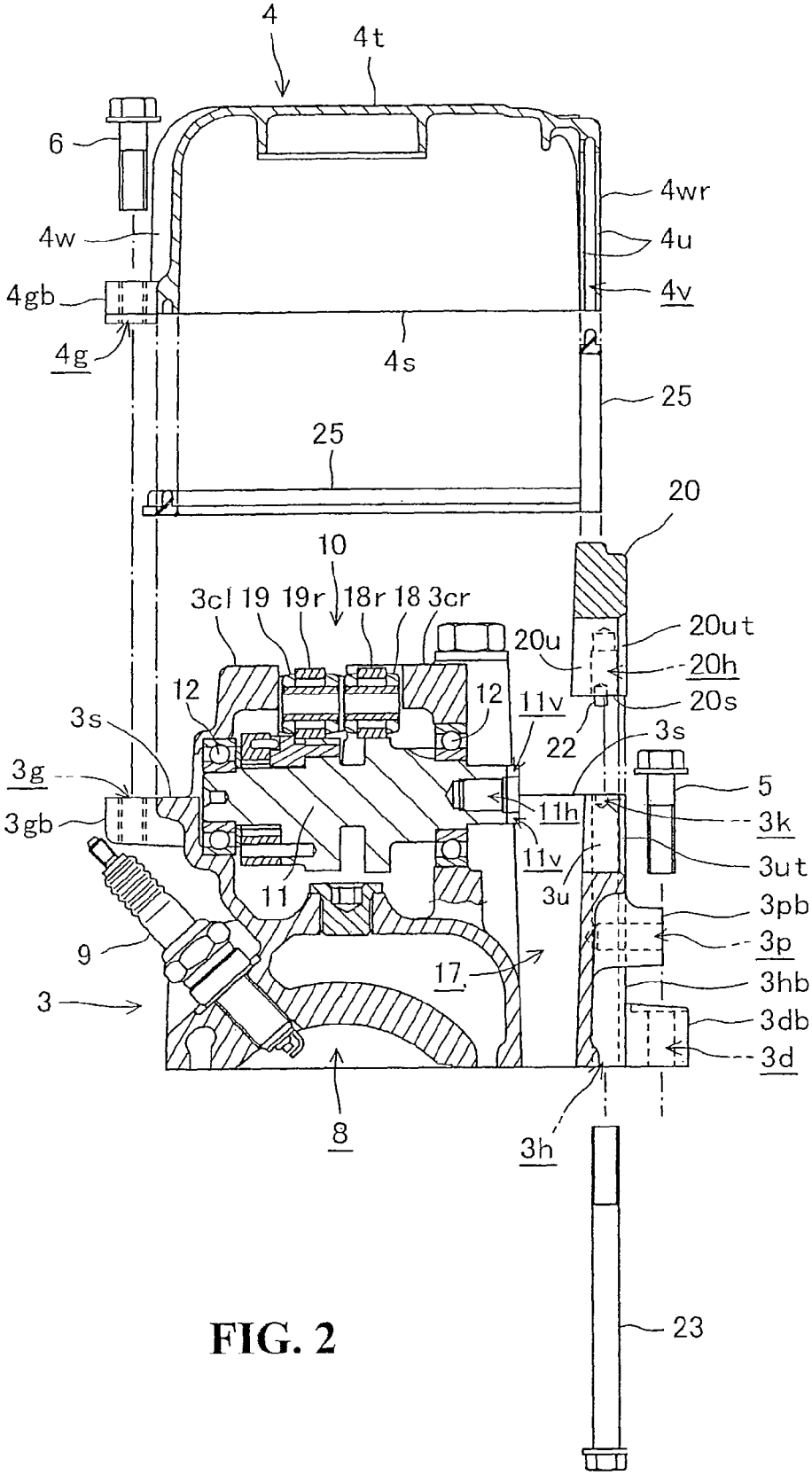
FIG. 2 is an exploded cross-sectional view illustrating the vicinity of the cylinder head of the internal combustion engine with a water pump removed.
Figure 3:
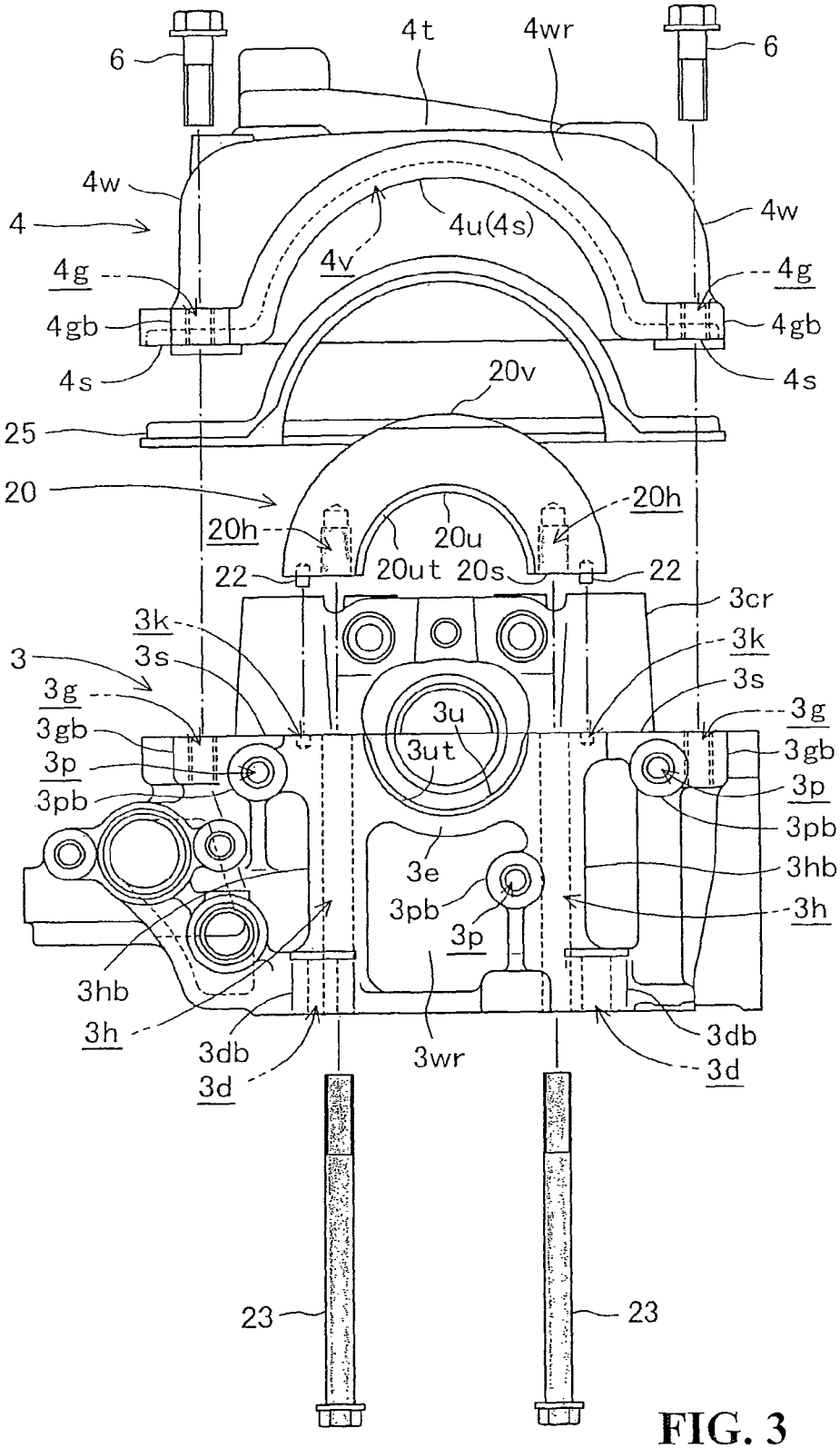
FIG. 3 is an exploded lateral view of FIG. 2.

With reference to FIGS. 2 and 3, the respective mating surfaces 3*s*, 4*s* of the right sidewalls 3*wr*, 4*wr* of the cylinder head 3 and the cylinder head cover 4 are partially formed with respective semicircular notch surfaces 3*u*, 4*u* each cut away in a semicircle to face each other. The semicircular cut-away surface 4*u* of the cylinder head cover 4 has an inner diameter greater than that of the semicircular cut-away surface 3*u* of the cylinder head 3.

A water pump holder 20 is sandwiched and interposed between the semicircular cut-away surface 4*u* of the cylinder head cover 4 and the mating surface 3*s* of the right sidewall 3*wr* of the cylinder head 3. This water pump holder 20 is formed in a hollow semicircular plate obtained by halving a hollow circular plate by a diameter, the hollow circular plate having an inner diameter equal to that of the semicircular cut-away surface 3*u* of the cylinder head 3 and an outer diameter equal to the inner diameter of the semicircular cut-away surface 4*u* of the cylinder head cover 4.

A semicircular cut-away surface 20*u* as a semicircular inner circumferential surface of the water pump holder 20 is opposed to a semicircular cut-away surface 3*u* of the cylinder head 3 to form a water pump support circular hole 21. The water pump 30 is fitted to and held by the water pump support circular hole 21.

With reference to FIGS. 2, 3 and 4, the right sidewall 3*wr* is formed with the semicircular cut-away surface 3*u* in the cylinder head 3 and forms the cam chain chamber 17 by partitioning it from the outside. The right sidewall 3*wr* is formed relatively thick by allowing a semicircular hole edge portion 3*e* forming the semicircular cut-away surface 3*u* to protrude outward (rightward). In addition, the right sidewall 3*wr* is formed with holder attachment bolt boss portions 3*hb*, 3*hb* outwardly protruding to form respective projecting ridges which extend vertically. The holder attachment bolt boss portion 3*hb*, 3*hb* have respective holder attachment bolt through-holes 3*h*, 3*h* vertically bored in front and rear of the semicircular hole edge portion 3*e*. (See FIG. 3.)

The upper end faces of the holder attachment bolt boss portions 3*hb*, 3*hb* are the mating surfaces 3*s*, 3*s* which are widely expanded right and left and in the front and rear of the semicircular cut-away surface 3*u* of the right sidewall 3*wr*. The holder attachment bolt through-holes 3*h*, 3*h* are open in the respective wide mating surfaces 3*s*, 3*s* adjacently to the semicircular cut-away surface 3*u* (see FIG. 4).

In addition, the mating surfaces 3*s*, 3*s* in front and rear of the circular cut-away surface 3*u* are formed with respective small-diameter pin holes 3*k*, 3*k* in a further forward and rearward position close to the respective holder attachment bolt through-holes 3*h*, 3*h*.

The right sidewalls 3*wr* of the cylinder head 3 are formed with cylinder head fastening bolt boss portions 3*db*, 3*db* which protrude rightward from the respective front and rear lower end portions. The cylinder head fastening bolt boss portions 3*db*, 3*db* are vertically bored with respective cylinder head fastening bolt through-holes 3*d*, 3*d*.

Further, the external surface of the right sidewall 3*wr* is formed around the semicircular edge portion 3*e* with three water pump attachment bolt boss portions 3*pb*, 3*pb*, 3*pb* which project to the right. The water pump attachment bolt boss portions 3*pb*, 3*pb*, 3*pb* are provided with respective water pump attachment bolt internal thread holes 3*p*, 3*p*, 3*p* which extend to the left.

As described above, the right sidewall 3*wr* which has the semicircular cut-away surface 3*u*, of the cylinder head 3, holding the water pump 30 and defines part of the cam chain chamber 17 is formed as below. The semicircular hole edge portion 3*e* defining the semicircular cut-away surface 3*u* holding the water pump 30 bulges outward and is formed relatively thick. The holder attachment bolt boss portions 3*hb*, 3*hb* in front and rear of the semicircular hole edge portion 3*e* externally bulge to form projecting ridges. The three water pump attachment bolt boss portions 3*pb*, 3*pb*, 3*pb* are formed around the semicircular edge portion 3*e* so as to project rightward. The cylinder head fastening bolt boss portions 3*db*, 3*db* are formed in front and rear of the lower end. Thus, the cylinder head 3 around the cam chain chamber 17 can naturally be increased in rigidity to increase the strength of the head fastening portion.

In addition, the right sidewall 3*wr* is formed at front and rear corners with upper end portions which bulge to the right along the mating surface 3*s* of the cylinder head 3 to form respective cover attachment boss portions 3*gb*, 3*gb*. In addition, the left side wall is formed at a front side position with an upper end portion which bulges to the left along the mating surface 3*s* of the cylinder head 3 to form a cover attachment boss portion 3*gb*.

The three cover attachment boss portions 3*gb*, 3*gb*, 3*gb* are formed with respective internal thread holes 3*g*, 3*g*, 3*g* which open in the mating surface 3*s*.

Figure 5:
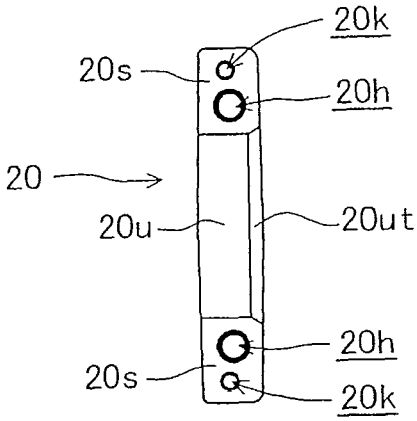
FIG. 5 is a back view of a water pump holder.

With reference to a back view of FIG. 5, the water pump holder 20 formed as the hollow semicircular plate forming the water pump support circular hole 21 by allowing the semicircular cut-away surface 3*u* of the cylinder head 3 to face the semicircular cut-away surface 20*u* is slightly thicker than the semicircular hole edge portion 3*e* having the same thickness as that of the cylinder head 3. Mating surfaces 20*s*, 20*s* allowed to conform with the respective mating surfaces 3*s*, 3*s* in front and rear of the semicircular cut-away surface 3*u* of the cylinder head 3 are formed with bolt internal thread holes 20*h*, 20*h* corresponding to the respective holder attachment bolt through-holes 3*h*, 3*h*. In addition, the mating surfaces 20*s*, 20*s* are formed with respective pin holes 20*k*, 20*k* at positions corresponding to respective pin holes 3*k*, 3*k*.

Knock pins 22 are generally half fitted into the corresponding pin holes 20*k*, 20*k* of the water pump holder 20. In this state, the projecting portions of the knock pins 22 are fitted into the corresponding pin holes 3*k*, 3*k* on the side of the cylinder head 3 for positioning. Thus, the mating surfaces 20*s*, 20*s* are allowed to precisely conform with the respective mating surfaces 3*s*, 3*s* of the cylinder head 3 in the front and rear of the semicircular cut-away surface 3*u*.

Elongate fastening bolts 23, 23 are passed, from below, through the respective holder attachment bolt through-holes 3*h*, 3*h* of the cylinder head 3 and threadedly engaged with the bolt internal thread holes 20*h*, 20*h* of the water pump holder 20. Thus, the water pump holder 20 is fastened to the end face of the right sidewall 3*wr* of the cylinder head 3.

The semicircular cut-away surface 3*u* of the cylinder head 3 is opposed to the semicircular cut-away surface 20*u* of the water pump holder 20 to form the water pump support circular hole 21.

In the state where the water pump holder 20 is fastened to the cylinder head 3 as described above, both the semicircular cut-away surface 3*u* of the cylinder head 3 and the semicircular cut-away surface 20*u* of the water pump holder 20 which form the water pump support circular hole 21 are subjected to planarization (co-process). Thus, a perfect-circular hole surface with a high degree of accuracy is formed.

In addition, the outer opening edge of the water pump support circular hole 21 is chamfered to form tapered surfaces 3*ut*, 20*ut*.

The cylinder head cover 4 put on the cylinder head 3 from above so as to cover the valve train 10 is composed of a rectangular outer lateral wall 4*w* continuously joined to the rectangular outer lateral wall 3*w* of the cylinder head 3 and an upper wall 4*t*. A right sidewall 4*wr* of the outer lateral wall 4*w* is such that the mating surface 4*s* is cut away to form the semicircular cut-away surface 4*u* having the inner diameter generally equal to the outer diameter of the semicircular outer circumferential surface 20*v* of the water pump holder 20.

Thus, the mating surface 4*s* which is an end face of the rectangular outer lateral wall 4*w* in the cylinder head cover 4 is composed of a surface opposed to the mating surface 3*s* of the cylinder head 3 and a semicircular cut-away surface 4*u* opposed to the semicircular outer circumferential surface 20*v* of the water pump holder 20. A cylinder cover gasket 25 is interposed between such surfaces opposed to each other.

Figure 6:
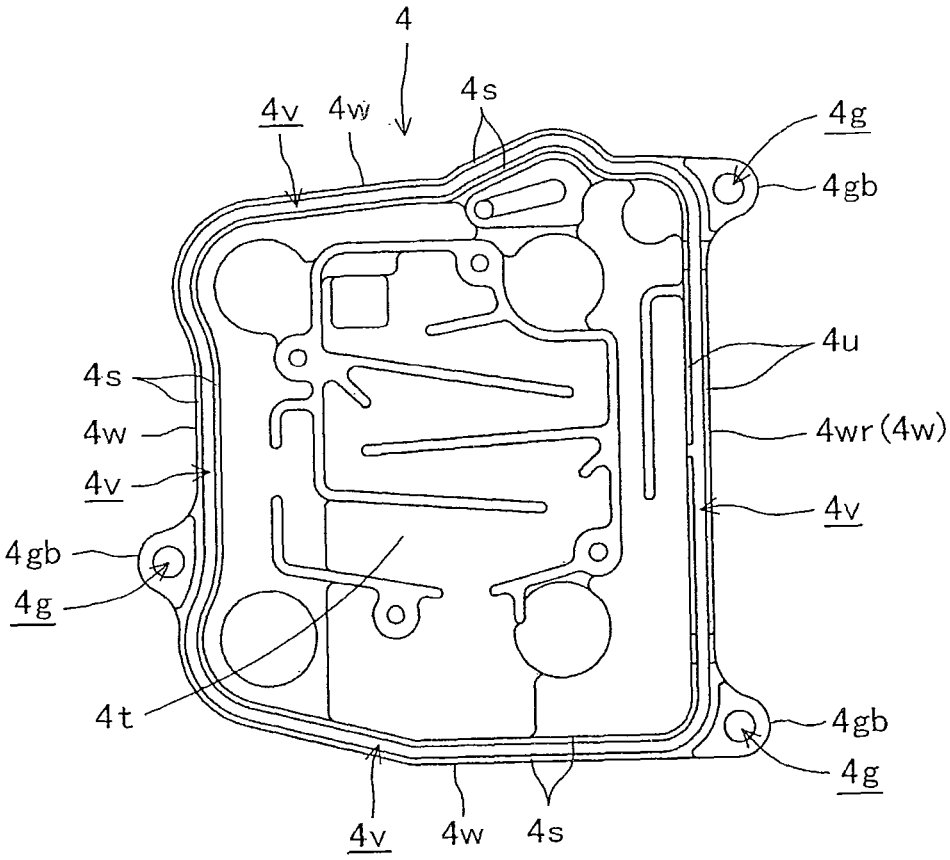
FIG. 6 is a back view of a cylinder head cover.

As illustrated in FIG. 6, the mating surface 4*s* of the cylinder head cover 4 is formed with an endless groove 4*v*.

Anteroposterior lower ends of the right sidewall 4*wr* along the mating surface 4*s* bulge forward to form respective attachment boss portions 4*gb*, 4*gb*. A front lower end of the left sidewall along the mating surface 4*s* bulges leftward to form an attachment boss portion 4*gb*.

The three attachment boss portions 4*gb*, 4*gb*, 4*gb* are bored with respective bolt through-holes 4*g*, 4*g*, 4*g*.

The projecting ridge of a cylinder cover gasket 25 T-shaped in cross-section is fitted to the groove 4*v* formed on the mating surface 4*s* of the cylinder head cover 4 so that the cylinder gasket 25 is attached to the mating surface 4*s*.

The cylinder head cover 4 where the cylinder cover gasket 25 is attached to the mating surface 4*s* is put on the cylinder head 3 attached with the water pump holder 20. The cylinder cover gasket 25 is liquid-tightly sandwiched between the mating surface 4*s* of the cylinder head cover 4, and the mating surface 3*s* of the cylinder head 3 and the semicircular outer circumferential surface 20*v* of the water pump holder 20. The bolts 6 are passed though the bolt through-holes 4*g* and threadedly engaged with the bolt internal thread holes 20*h*. Thus, the cylinder head cover 4 is attached to the cylinder head 3.

The water pump support circular hole 21 formed by fastening the water pump holder 20 to the cylinder head 3 has a central axis aligned with that of the camshaft 11.

The water pump 30 is fitted into and supported by the water pump support circular hole 21.

With reference to FIGS. 1 to 7, a water pump housing 31 of the water pump 30 includes an elongate cylindrical portion 31*a* and a short cylindrical portion 31*b*. The elongate cylindrical portion 31*a* extends axially and rotatably supports a water pump drive shaft 33 via a bearing 35. The short cylindrical portion 31*b* expands radially but is axially short. In addition, the short cylindrical portion 31*b* has an axially extending opening end to partially house an impeller 34 fitted to the water pump drive shaft 33. A water pump cover 32 is superimposed on the opening end face of the short cylindrical portion 31*b*. This water pump cover 32 shields the right opening of the short cylindrical portion 31*b* of the water pump housing 31 and houses the impeller 34 along with the short cylindrical portion 31*b*.

The short cylindrical portion 31*b* of the water pump housing 31 is formed with four bolt holes 31*h* on the outer circumference. Also the water pump cover 32 is formed with four bolt holes 32*h* corresponding to the respective bolt holes 31*h* of the water pump housing 31.

Figure 7:
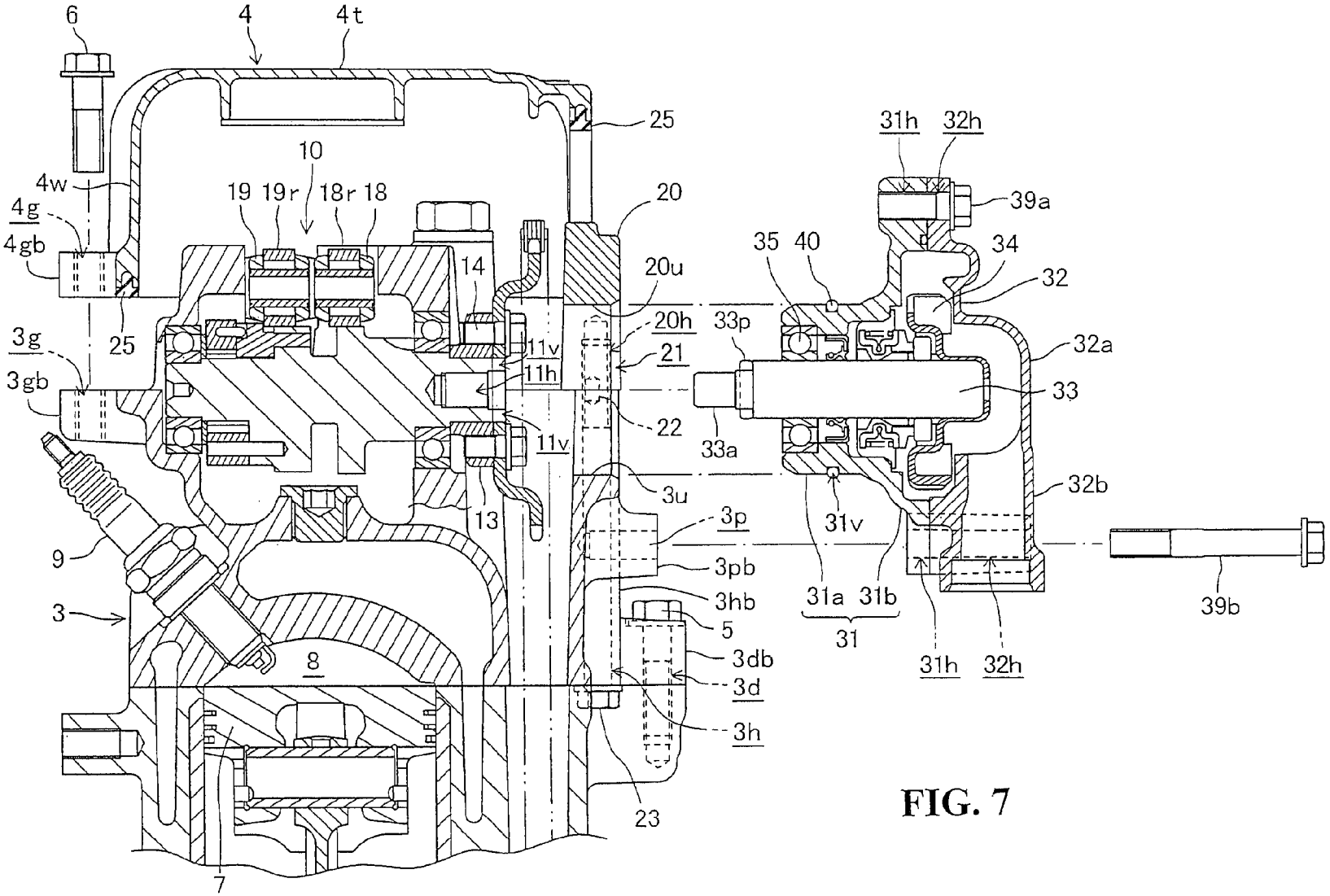
FIG. 7 is an exploded cross-sectional view of the internal combustion engine with the cylinder head cover and a water pump removed.

As illustrated in FIG. 7, the bolt internal thread hole 31*h* of the water pump housing 31 located close to the upper portion of the cylinder head cover 4 is threaded with female screws. In addition, a bolt 39*a* passed through the corresponding bolt hole 32*h* of the water pump cover 32 is threadedly engaged with the corresponding bolt internal thread hole 31*h* to fasten the water pump cover 32 to the water pump housing 31.

The other three bolt holes 31*h*, 32*h* correspond to the respective three water pump attachment internal thread holes 3*p* (see FIG. 3) formed in the right sidewall 3*wr* of the cylinder head 3 and are superimposed to the respective water pump attachment bolt boss portions 3*pb*. Bolts 39*b* are passed through the corresponding bolt holes 32*h*, 31*h* and threadedly engaged with the corresponding water pump attachment bolt internal thread holes 3*p* (see FIGS. 1 and 8) to co-fasten the water pump housing 31 and the water pump cover 32 to the right sidewall 3*wr* of the cylinder head 3. In this way, the water pump 30 is attached to the cylinder head 3.

Figure 8:
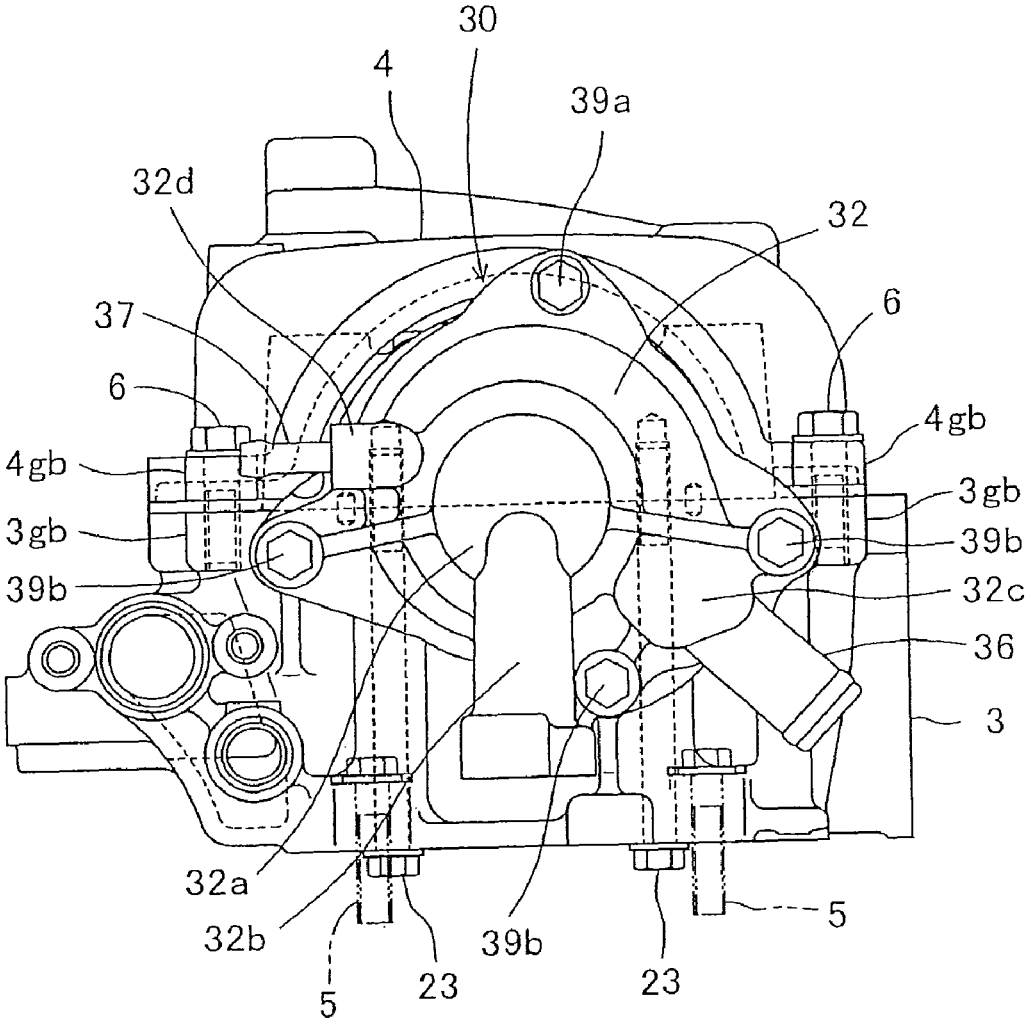
FIG. 8 is a lateral view of an essential portion of the internal combustion engine.

In addition, referring to FIG. 8, the water pump cover 32 is formed as below. An intake port portion 32*a* protrudes toward the right of the water pump drive shaft 33. A water suction cylindrical portion 32*b* extends from the intake port portion 32*a* in the direction of the crankshaft along the right lateral surface of the cylinder head 3. A discharge port portion 32*c* extends obliquely rearward and downward from the outer circumferential lower portion of the impeller 34 in a tangential direction. Further, a discharge connection pipe 36 is further provided to project from the discharge port portion 32*c*.

An air-bleeding portion 32*d* is formed at an upper rear portion on the outer circumference of the impeller 34. In addition, an air-bleeding connection pipe 37 is provided to project obliquely rearwardly and upwardly from the air-bleeding portion 32*d*.

As illustrated in FIG. 7, the elongate cylindrical portion 31*a* fitted into the water pump support circular hole 21 of the water pump housing 31 is fully circumferentially formed with an outer circumferential groove 31*v* on the outer circumferential surface thereof. An O-ring 40 is fitted to the outer circumferential groove 31*v*. The O-ring 40 is sandwiched between the semicircular cut-away surfaces 3*u*, 20*u* of the water pump support circular hole 21 formed with a high degree of accuracy by a co-process. Thus, the water pump housing 31 is liquid-tightly fitted into the water pump support circular hole 21 and reliably sealed and attached thereto.

In addition, the outer opening edge of the water pump support circular hole 21 is chamfered to form the tapered surfaces 3*ut*, 20*ut*. Therefore, the water pump support circular hole 21 can be positioned with respect to the elongate cylindrical portion 31*a* of the water pump housing 31 and the elongate cylindrical portion 31*a* can easily be fitted into the water pump support circular hole 21.

When the water pump 30 is fitted into the water pump support circular hole 21, a reduced-diameter end portion 33*a* of the water pump drive shaft 33 is inserted into a fitted-into hole 11*h* of an end face of the cam shaft 11 located axially therewith. A pin 33*p* is diametrically fitted into the reduced-diameter end portion 33*a* and has both ends projecting therefrom. Both the ends of the pin 33*p* are fitted into respective grooves 11*v*, 11*v* resulting from diametrically cutting away an opening end edge of the fitted-into hole 11*h* and are joined thereto. The rotation of the camshaft 11 is transmitted to the water pump drive shaft 33 coaxially connected thereto so that the camshaft 11 and the water pump drive shaft 33 are rotated together. Thus, the water pump 30 is driven to circulate cooling water to cool the internal combustion engine 1.

In the water pump attachment structure of the internal combustion engine 1, while maintaining the state where the water pump 30 is fitted into the water pump support circular hole 21 and secured to the cylinder head 3, the cylinder head cover 4 can be removed. Therefore, the maintenance work of the valve train 10 such as the adjustment of a tappet clearance can be done with ease.

In addition, in the state where the cylinder head cover 4 is put on and fastened to the cylinder head 3, the water pump 30 can be removed. Therefore, also the maintenance work of the water pump 30 can be facilitated.

In addition, the water pump 30 directly driven by the camshaft 11 coaxially connected to the pump drive shaft 33 is disposed across the mating surface 3*s* of the cylinder head 3 and the mating surface 4*s* of the cylinder head cover 4. The mating surfaces 3*s*, 4*s* are made flush with the cam shaft 11 to lower the upper end of the outer lateral wall 3*w* of the cylinder head 3, thus reducing the weight of the cylinder head 3.

The water pump holder 20 is fastened to the cylinder head 3 by being positioned with respect thereto by means of the knock pins 22 engaged with the respective engaging holes 3*k*, 20*k* formed at the respective given positions of the mating surfaces 3*s*, 20*s*. Therefore, the accuracy of the attachment position of the water pump holder 20 to the cylinder head 3 can be highly maintained. In addition, the sealing performance can made satisfactory when the water pump 30 is fitted into and supported by the water pump support circular hole 21.

The holder attachment bolt through-holes 3*h*, 3*h* of the cylinder head 3 are formed adjacent to and on both sides of the semicircular cut-away surface 3*u*. The semicircular cut-away surface 3*u* of the cylinder head 3 is formed to have an axial width greater than the inner diameter of the holder attachment bolt through-hole 3*h*. Therefore, while making the support of the water pump 30 satisfactory, the broad semicircular cut-away surface is used to enlarge the holder attachment bolt boss portions 3*hb* of the holder attachment bolt through-holes 3*h*, thereby increasing the boss strength.

The semicircular cut-away surfaces 3*u*, 20*u* of the water pump support circular hole 21 formed by fastening the water pump holder 20 to the cylinder head 3 are subjected to planarization by the co-process. Therefore, the water pump support circular hole 21 can be made as a perfect-circular hole surface with a high degree of accuracy. The elongate cylindrical portion 31*a* of the water pump housing 31 of the water pump 30 is liquid-tightly fitted into the water pump support circular hole 21 via the O-ring 40. With such a simple structure, high sealing performance can be ensured.

Figure 9:
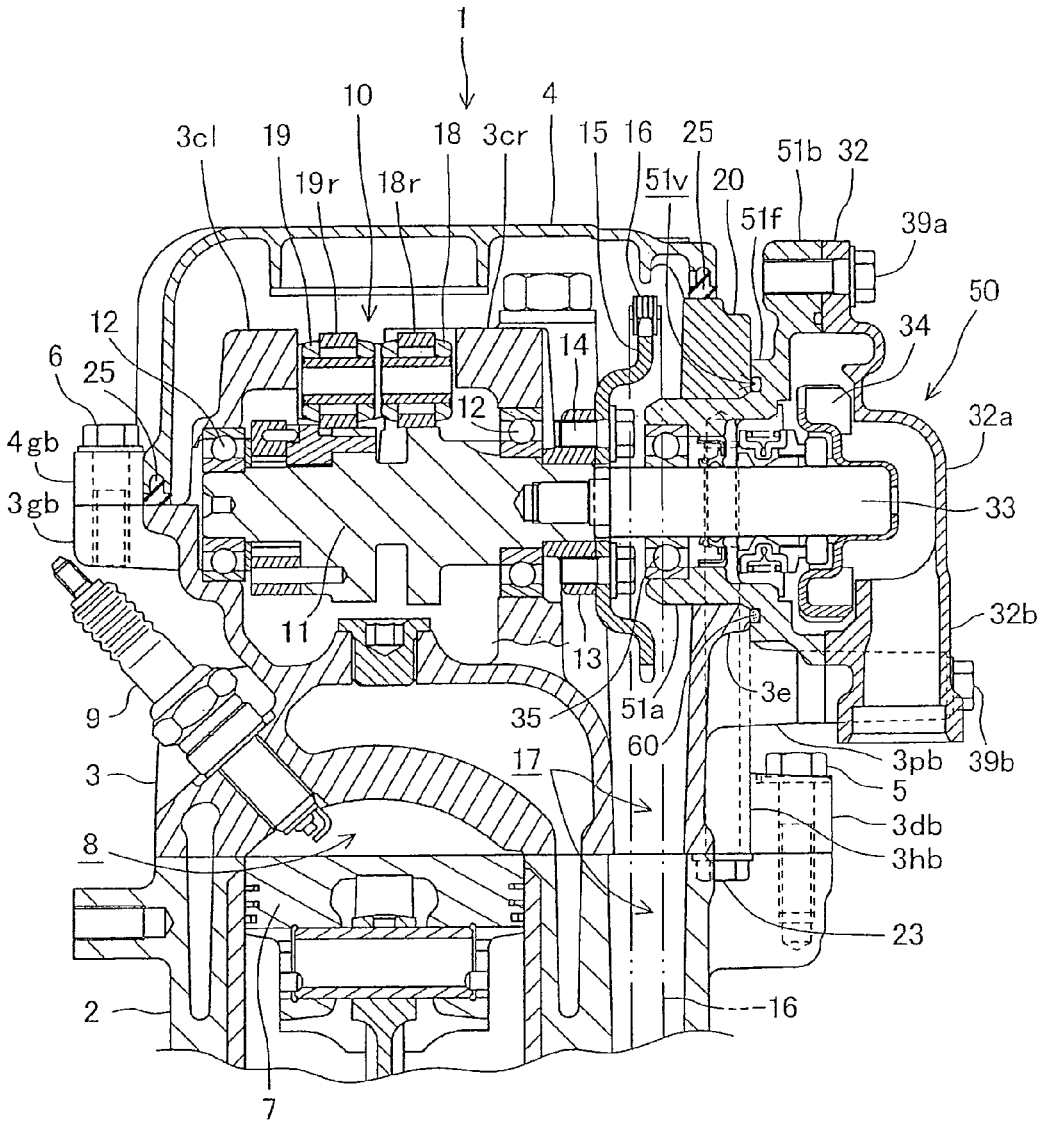
FIG. 9 is a cross-sectional view illustrating the vicinity of a cylinder head of an internal combustion engine according to another embodiment.

A description is next given of another sealing structure for the attachment of a water pump by way of example with reference to FIG. 9.

A water pump 50 of this embodiment is the same as that of the embodiment described above except for a water pump housing 51. Therefore, the other elements are indicated with like reference numerals in the embodiment described above.

An elongate cylindrical portion 51*a* of the water pump housing 51 is formed integrally with a flange portion 51*f* at an enlarged-diameter portion of a short cylindrical portion 51*b*. The flange portion 51*f* is opposed to a right lateral surface of the right sidewall 3*wr* of the cylinder head 3 and to a right lateral surface of the water pump holder 20, the right sidewall 3*wr* and the water pump holder 20 forming the water pump support circular hole 21 and both the right lateral surfaces being flush with each other. A circular groove 51*v* is formed around the pump drive shaft 33 and in a plane of the flange portion 51*f* opposed to the right sidewall 3*wr* of the cylinder head 3 and to the water pump holder 20.

An O-ring 60 is fitted into the circular groove 51*v*. In this state, the elongate cylindrical portion 51*a* of the water pump housing 51 is fitted into the water pump support circular hole 21. The flange portion 51*f* is brought into liquid-tight abutment against the outer opening end face (the respective right lateral surfaces of the right sidewall 3*wr* of the cylinder head 3 and the water pump holder 20) of the water pump support circular hole 21. In this way, the water pump 50 is secured to the cylinder head 3 by means of bolts 39*b*. With such a simple structure, the sealing performance can be highly maintained.

In this structure, it is not necessary to co-process the cylinder head 3 and the water pump holder 20.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water pump attachment structure for a water-cooled internal combustion engine, in which a valve train having a camshaft disposed on a cylinder head is provided so as to be covered by a cylinder head cover comprising:

a water pump having a pump drive shaft directly driven by the camshaft is disposed across a mating surface of the cylinder head and a mating surface of the cylinder head cover, wherein the cylinder head has a sidewall formed with a semicircular cut-away surface resulting from cutting away the mating surface with the cylinder head cover in a semicircle, and has screw boss portions having screw through-holes passing through the mating surface, the screw boss portions being formed on both sides of the semicircular cut-away surface, a water pump holder, formed with a semicircular cut-away surface symmetrically opposed to the semicircular cut-away surface of the cylinder head, and with internal thread holes in the mating surface with the cylinder head so as to correspond to the respective screw through-holes, forms a water pump support circular hole by allowing a semicircular cut-away surface thereof to face the semicircular cut-away surface of the cylinder head, and screw members are passed through the respective screw through-holes of the cylinder head and are threadedly engaged with the respective internal thread holes of the water pump holder for fastening the water pump holder to the cylinder head, a water pump is fitted into and secured to the water pump support circular hole, and the mating surface of the cylinder head cover conforms to the mating surface of the cylinder head and is attached to the cylinder head with the water pump holder liquid-tightly sandwiched therebetween.

2. The water pump attachment structure of the water-cooled internal combustion engine according to claim 1, wherein the water pump holder is positioned with respect to and fastened to the cylinder head by a knock pin engaged with an engaging hole formed at a given position on the mating surface of the cylinder head and of the water pump holder.

3. The water pump attachment structure of the water-cooled internal combustion engine according to claim 2, wherein the screw through-holes of the cylinder head are formed adjacent to both respective sides of the semicircular cut-away surface, and the semicircular cut-away surface of the cylinder head has an axial width greater than an internal diameter of the screw through-hole.

4. The water pump attachment structure of the water-cooled internal combustion engine according to claim 2, wherein an external sidewall defining a cam chain chamber of the cylinder head includes a water pump attachment bolt boss portion adapted to secure the water pump and with a cylinder head fastening bolt boss portion adapted to fasten the cylinder head to a cylinder block.

5. The water pump attachment structure of the water-cooled internal combustion engine according to claim 3, wherein the corresponding semicircular cut-away surfaces of the water pump support circular hole formed by fastening the water pump holder to the cylinder head are subjected to planarization by a co-process, and a cylindrical portion of a water pump housing rotatably supporting the pump drive shaft of the water pump is liquid-tightly fitted into the water pump support circular hole via an O-ring to support the water pump.

6. The water pump attachment structure of the water-cooled internal combustion engine according to claim 1, wherein the screw through-holes of the cylinder head are formed adjacent to both respective sides of the semicircular cut-away surface, and the semicircular cut-away surface of the cylinder head has an axial width greater than an internal diameter of the screw through-hole.

7. The water pump attachment structure of the water-cooled internal combustion engine according to claim 6, wherein the corresponding semicircular cut-away surfaces of the water pump support circular hole formed by fastening the water pump holder to the cylinder head are subjected to planarization by a co-process, and a cylindrical portion of a water pump housing rotatably supporting the pump drive shaft of the water pump is liquid-tightly fitted into the water pump support circular hole via an O-ring to support the water pump.

8. The water pump attachment structure of the water-cooled internal combustion engine according to claim 6, wherein a cylindrical portion of a water pump housing rotatably supporting the pump drive shaft of the water pump is formed with a flange portion, and the cylindrical portion of the water pump housing is fitted into the water pump support circular hole so that the flange portion is liquid-tightly abutted against an external opening end face of the water pump support circular hole via an O-ring to support the water pump.

9. The water pump attachment structure of the water-cooled internal combustion engine according to claim 6, wherein an external sidewall defining a cam chain chamber of the cylinder head includes a water pump attachment bolt boss portion adapted to secure the water pump and with a cylinder head fastening bolt boss portion adapted to fasten the cylinder head to a cylinder block.

10. The water pump attachment structure of the water-cooled internal combustion engine according to claim 7, wherein an external sidewall defining a cam chain chamber of the cylinder head includes a water pump attachment bolt boss portion adapted to secure the water pump and with a cylinder head fastening bolt boss portion adapted to fasten the cylinder head to a cylinder block.

11. The water pump attachment structure of the water-cooled internal combustion engine according to claim 8, wherein an external sidewall defining a cam chain chamber of the cylinder head includes a water pump attachment bolt boss portion adapted to secure the water pump and with a cylinder head fastening bolt boss portion adapted to fasten the cylinder head to a cylinder block.

12. The water pump attachment structure of the water-cooled internal combustion engine according to claim 1, wherein an external sidewall defining a cam chain chamber of the cylinder head includes a water pump attachment bolt boss portion adapted to secure the water pump and with a cylinder head fastening bolt boss portion adapted to fasten the cylinder head to a cylinder block.

13. A water pump attachment structure for a water-cooled internal combustion engine wherein a valve train with a camshaft disposed on a cylinder head is covered by a cylinder head cover comprising:

a water pump having a pump drive shaft directly driven by the camshaft, said water pump being disposed across a mating surface of the cylinder head and a mating surface of the cylinder head cover;

a sidewall of the cylinder head includes a semicircular cut-away surface formed by cutting away the mating surface with the cylinder head cover in a semicircle;

screw boss portions formed in the sidewall with screw through-holes passing through the mating surface, the screw boss portions being formed on both sides of the semicircular cut-away surface;

a water pump holder formed with a semicircular cut-away surface symmetrically opposed to the semicircular cut-away surface of the cylinder head;

internal thread holes being formed in the mating surface with the cylinder head to correspond with the respective screw through-holes for forming a water pump support circular hole by positioning a semicircular cut-away surface thereof to face the semicircular cut-away surface of the cylinder head; and screw members positioned through the respective screw through-holes of the cylinder head and being threadedly engaged with the respective internal thread holes of the water pump holder for fastening the water pump holder to the cylinder head;

said mating surface of the cylinder head cover conforming to the mating surface of the cylinder head and being attached to the cylinder head with the water pump holder liquid-tightly sandwiched therebetween.

14. The water pump attachment structure of the water-cooled internal combustion engine according to claim 13, wherein the water pump holder is positioned with respect to and fastened to the cylinder head by a knock pin engaged with an engaging hole formed at a given position on the mating surface of the cylinder head and of the water pump holder.

15. The water pump attachment structure of the water-cooled internal combustion engine according to claim 14, wherein the screw through-holes of the cylinder head are formed adjacent to both respective sides of the semicircular cut-away surface, and the semicircular cut-away surface of the cylinder head has an axial width greater than an internal diameter of the screw through-hole.

16. The water pump attachment structure of the water-cooled internal combustion engine according to claim 15, wherein the corresponding semicircular cut-away surfaces of the water pump support circular hole formed by fastening the water pump holder to the cylinder head are subjected to planarization by a co-process, and a cylindrical portion of a water pump housing rotatably supporting the pump drive shaft of the water pump is liquid-tightly fitted into the water pump support circular hole via an O-ring to support the water pump.

17. The water pump attachment structure of the water-cooled internal combustion engine according to claim 13, wherein the screw through-holes of the cylinder head are formed adjacent to both respective sides of the semicircular cut-away surface, and the semicircular cut-away surface of the cylinder head has an axial width greater than an internal diameter of the screw through-hole.

18. The water pump attachment structure of the water-cooled internal combustion engine according to claim 17, wherein the corresponding semicircular cut-away surfaces of the water pump support circular hole formed by fastening the water pump holder to the cylinder head are subjected to planarization by a co-process, and a cylindrical portion of a water pump housing rotatably supporting the pump drive shaft of the water pump is liquid-tightly fitted into the water pump support circular hole via an O-ring to support the water pump.

19. The water pump attachment structure of the water-cooled internal combustion engine according to claim 17, wherein a cylindrical portion of a water pump housing rotatably supporting the pump drive shaft of the water pump is formed with a flange portion, and the cylindrical portion of the water pump housing is fitted into the water pump support circular hole so that the flange portion is liquid-tightly abutted against an external opening end face of the water pump support circular hole via an O-ring to support the water pump.

20. The water pump attachment structure of the water-cooled internal combustion engine according to claim 13, wherein an external sidewall defining a cam chain chamber of the cylinder head includes a water pump attachment bolt boss portion adapted to secure the water pump and with a cylinder head fastening bolt boss portion adapted to fasten the cylinder head to a cylinder block.

* * * * *